United States Patent [19]

Brown et al.

[11] Patent Number: 4,539,748

[45] Date of Patent: Sep. 10, 1985

[54] METHODS OF MAKING AN ELECTRICAL CONNECTOR

[75] Inventors: Robert J. Brown; Douglas R. Fernandez, both of Lawrenceville; Charles McGonigal, Grayson, all of Ga.

[73] Assignee: AT&T Technologies, Inc., Berkeley Heights, N.J.

[21] Appl. No.: 626,800

[22] Filed: Jul. 2, 1984

Related U.S. Application Data

[62] Division of Ser. No. 403,906, Jul. 30, 1982, Pat. No. 4,472,596.

[51] Int. Cl.[3] ..... H01R 43/00

[52] U.S. Cl. ..... 29/874; 403/300

[58] Field of Search ..... 29/866, 874, 884; 339/98, 99, 278 T, 47 R, 97 C; 403/302, 309, 300, 313

[56] References Cited

U.S. PATENT DOCUMENTS

| | | |
|---|---|---|
| 2,116,269 | 5/1938 | Kobzy . |
| 2,416,335 | 2/1947 | Macy . |
| 3,012,219 | 12/1961 | Levin et al. . |
| 3,077,027 | 2/1962 | Sola et al. . |
| 3,084,072 | 11/1962 | Graff et al. . |
| 3,320,354 | 5/1967 | Marley et al. . |
| 3,410,950 | 11/1968 | Freundenberg . |
| 3,496,522 | 2/1970 | Ellis, Jr. et al. . |
| 3,539,707 | 11/1970 | Kindell et al. . |
| 3,611,264 | 10/1971 | Ellis, Jr. . |
| 3,772,635 | 11/1973 | Frey et al. . |
| 3,858,158 | 12/1974 | Henn et al. . |
| 3,962,901 | 6/1976 | Anderson et al. . |
| 4,118,596 | 10/1978 | Bassett et al. . |
| 4,176,240 | 11/1979 | Sabia . |
| 4,288,918 | 9/1981 | Nijman . |
| 4,310,212 | 1/1982 | Aujla et al. . |
| 4,312,556 | 1/1982 | Dufau . |
| 4,385,794 | 5/1983 | Lucius . |

FOREIGN PATENT DOCUMENTS

| | | |
|---|---|---|
| 2438178 | 3/1975 | Fed. Rep. of Germany . |
| 2436510 | 4/1980 | France . |

*Primary Examiner*—Mark Rosenbaum
*Assistant Examiner*—Carl J. Arbes
*Attorney, Agent, or Firm*—E. W. Somers

[57] ABSTRACT

An electrical connector which is capable of being used to interconnect insulated conductors in the field or in a factory during in-line processing includes a frame and contact element. The contact element which is used to establish an electrical connection between the conductors includes a center portion and two opposed bifurcated beams. A portion of each beam is upstanding from the plane of the contact element. Furcations of each beam define a slot for receiving one of the conductors to be interconnected. The contact element is attached to the frame which includes at least one deformable tang at each end. End portions of conductors to be connected are each positioned across an end of the frame. The tangs are wrapped about the conductors, the conductors are moved into the slots of the beams, and excess portions of the lengths severed. The tang at each end cooperates with an offset portion connected to the frame and which is interposed between the tang and the upstanding portion of the adjacent bifurcated beam to mechanically secure the conductor at that end and provide strain relief therefor.

4 Claims, 16 Drawing Figures

METHODS OF MAKING AN ELECTRICAL CONNECTOR

This is a division of application Ser. No. 403,906 filed July 30, 1982, now U.S. Pat. No. 4,472,596 issued Sept. 18, 1984.

TECHNICAL FIELD

This invention relates to methods of making an electrical connector, and, more particularly, to methods of making a connector which is suitable for coaxially splicing insulated conductors to establish an electrical connection therebetween.

BACKGROUND OF THE INVENTION

In the communications industry, millions of electrical connections between insulated conductors are made each year. These connections must be easily and inexpensively made. Also, the electrical connections which are made must be reliable and must be maintained over a period of time during which forces may be applied to the insulated conductors.

Some connections, which are called in-line, are made in the factory during processing of the insulated conductors and cable which includes the conductors. A trailing end of one supply of an insulated conductor must be spliced to a leading end of another supply to allow continuous processing. Typically, these splices have been made by the use of a solder ring in a heat shrinkable plastic tube or by brazing, both of which rely on the application of heat energy and on operator dexterity. Connectors which are used in factory splicing must be capable of being advanced over sheaves, for example, during further processing. Other connections are made outside the factory, in the field, under conditions which require simplicity and low cost.

Connectors are available which do not require the stripping of the insulation from an end of the conductor prior to making the connection. Such connectors are widely used and are known as solderless connectors. One such solderless electrical connector for insulated electrical conductors is referred to as a B-wire connector. It includes a plurality of coaxially telescopically disposed sleeves including an inner sleeve of electrically conductive material and an outer jacket of electrically insulating material. The inner sleeve is provided on its inner surface with spaced apart perforations defining inwardly extending insulation-piercing and wire-engaging tangs. A pair of insulated electrical conductors or wires may be inserted into the inner sleeve. Their end portions are confined and embraced by the tangs on the inner sleeve. Electrical contact with the metallic portion of the wires is established when the connection is deformed by pressure applied on the outside thereof. A crushing action is thereby exerted on the inner sleeve, forcing the tangs through the insulation and causing them to engage the metallic conducting portions. One such connector is more fully described and illustrated in U.S. Pat. No. 3,064,072 granted Nov. 13, 1962 to H. T. Graff et al.

Connectors of this type have been used by the millions. However, difficulty has been experienced in that upon insertion into the inner sleeve, the conductors may hang-up on the inwardly projecting tangs. Although an operator may play the conductors free of the tangs during assembly thereof, which in itself may be time-consuming, there is no assurance that the conductors have bottomed within the connector. This connector is relatively inexpensive and easy to use without the necessity for special hand tools, but it relies on a crimping operation to establish the electrical connection. As a result, contact resistance may change significantly with age.

Another type of solderless splicing connector which is most economical for a relatively small number of connections is one which is shown in U.S. Pat. No. 3,012,219. It uses a U-shaped contact element being made of a metallic material and having upstanding bifurcated end portions that are received in a plastic housing. A slot formed at each end extends inwardly and is adapted to receive an insulated conductor. A plastic cover is mounted in a first position on the housing. Conductors are inserted into openings to cause the conductors to be aligned with conductor-receiving slots formed in the upstanding bifurcated end portions. The cover is moved to a second position on the housing to cause the conductors to be moved into the conductor-receiving slots. Because the slots are narrower than the diameter of the wire portions, the insulation is penetrated and contact is made between the exposed conductors and the contact elements.

A split beam contact element which is widely used in telecommunications for interconnecting insulated conductors includes a center portion with beams extending colinearly thereform. Each of the beams is bifurcated with the furcations of each forming a conductor-receiving slot. A plurality of the split beam contact elements are mounted in a dielectric housing. To establish a connection, an insulated conductor is moved into one slot and another conductor into the opposite slot. Surfaces that define the entrances to the slots and the slots themselves are configured to engage the conductive element of each conductor to establish an electrical connection between the conductors. This is a stored energy connection device. Should the conductor relax with age, the resilient furcations of the beam move together to re-establish a gas-tight connection. See for example U.S. Pat. No. 3,496,522 which issued on Feb. 17, 1970 in the names of B. C. Ellis et al and U.S. Pat. Nos. 3,611,264 and 3,772,635. Connector systems such as that shown and claimed in U.S. Pat. No. 3,858,158 which issued on Dec. 31, 1974, in the names of R. W. Henn et al are available for splicing together a plurality of conductors simultaneously.

Although the priorly described U-shaped contact element connector and those typified by the Ellis and Henn patents are suitable for field connections, they are not adaptable to connect conductors that are further processed in a factory. The so-called B-wire connector approaches the sought-after connector, but it falls short of the desired reliability, is too time consuming in its use and is too large for subsequent processing. Also, it is not an in-line connector, inasmuch as the conductors to be spliced are disposed side-by-side and inserted into the same end of the connector.

Notwithstanding the availability of these connectors for splicing, there is still a need for one that is adapted to universal use in the factory and in the field. The sought-after connector must be one which may be used to establish an in-line connection between two conductors, said connection being one which does not inhibit further processing. It also should be one which does not require the use of heat and which is not operator-sensitive. The connector also should be one in which the connection is a mechanical one as opposed to one which relies on soldering or brazing. A further consideration should be that the connection is able to be made without the need for tailoring the length of the conductor to the connector. Rather, it should be one where the conductor ends are postioned in the connector after which excess ends are severed.

SUMMARY OF THE INVENTION

The foregoing problems of the prior art have been overcome by an electrical connector which is used to connect elongated conductors together electrically and coaxially, and which provides a separate mechanical connection between the conductors. The electrical connector includes a contact element portion which establishes an electrical connection between conductors such as insulated conductors. Also, the connector includes a frame which holds the contact element portion and which causes portions of the conductors that are connected electrically to the contact element portion to be secured against unintended longitudinal movement. The frame is connected to deformable tang at each end and an offset portion adjacent to each tang. The contact element portion is disposed between the two offset portions and is connected to the frame. The contact element portion includes opposed beams which are made of an electrically conductive material and which are connected together electrically. One end of each beam is bifurcated with furcations of each bifurcated end having a conductor-receiving slot therebetween. The other end of each beam is connected to the frame. A portion of each bifurcated end projects from a plane through the other ends of the beams. The offset portion adjacent to each tang causes each conductor between an end of the connector and the bifurcated end portion of the adjacent beam to be disposed in a tortuous path. This arrangement isolates the electrical connection of each conductor to a beam of the contact element portion from forces which may be applied to the conductor.

Forces applied to either of the insulated conductors during use are resisted by the strain relief system provided by the cooperation between each offset portion and the adjacent tang. This avoids stressing of the electrical connection at the contact element and allows a gas-tight connection between the insulated conductors and the contact element to be maintained throughout the use of the connector.

A method of making the electrical connector includes the steps of moving a strip of metallic material through a plurality of workstations and removing material from the strip to form a blank including contact element means which includes two opposed beams connected together electrically and having bifurcated first end portions with the furcations of each bifurcated end portion having a conductor-receiving slot formed therebetween. The blank also has a frame which includes lateral portions extending transversely across the strip for supporting said contact element means and being connected to the second end portions of the beams and which is connected at each end to an end portion of the connector along which are formed tangs for securing a conductor to the connector. Each blank is separated from the strip and portions of the first end portions of the beams are caused to project from the plane of the blank. The tangs at each end of the connector are bent out of the plane of the blank to cause them to be adapted to receive a conductor and adapted to be wrapped about the conductor, and an offset is formed in each end portion of the connector between the tangs at that end and the frame.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figures 1, 4:
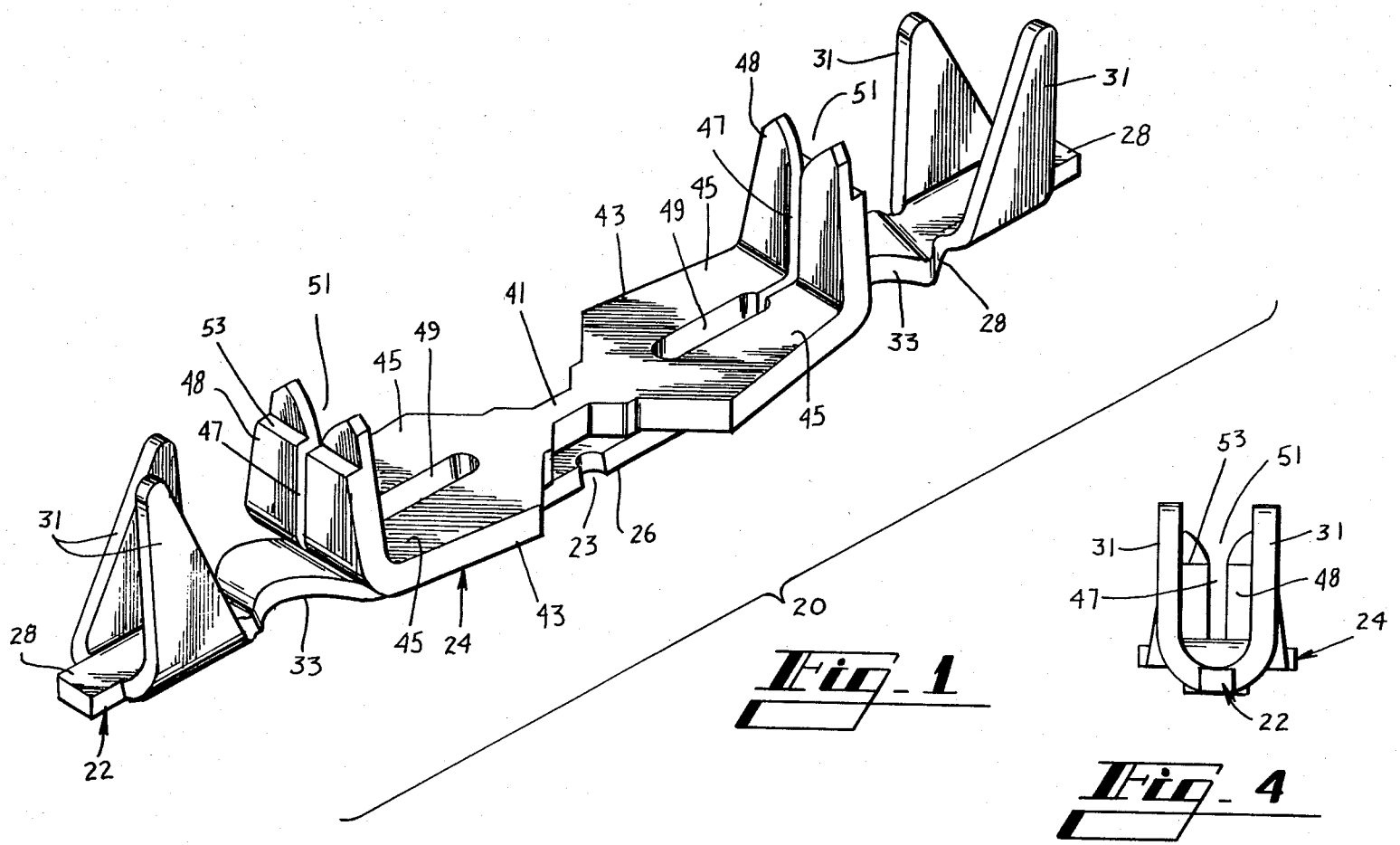
FIG. 1 is a perspective view of an electrical connector.
FIG. 4 is an end view of the connector of FIG. 2.
Figure 5:
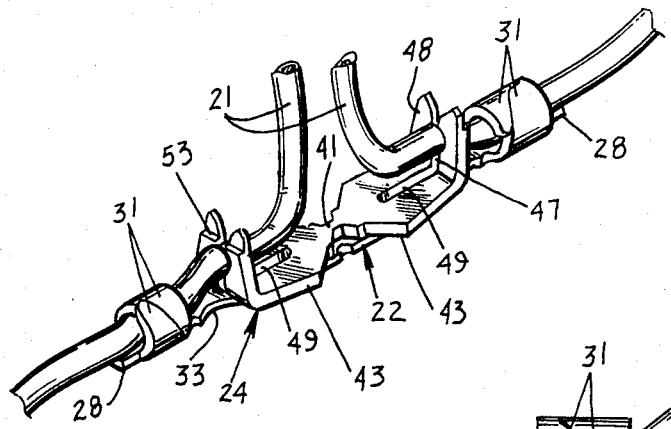
FIG. 5 is a perspective view of the connector with two conductors connected thereto prior to trimming of the conductor ends.

Referring now to FIG. 1, there is shown a preferred embodiment of an electrical connector, said connector being designated generally by the numeral 20. The electrical connector 20 is capable of connecting electrically two conductors such as insulated conductors 21—21 (see FIG. 5) without the necessity of stripping insulation from the conductive portions thereof. For ease of manufacture and for simplicity in use, the electrical connector 20 includes a support portion such as a base 22 and a contact element portion 24. The base 22 is designed to mechanically secure two conductors 21—21 together while the contact element portion 24 is designed to establish an electrical connection therebetween.

Both the base and the contact element of the connector 20 are made from flat strip stock material such as Phosphor bronze having suitable mechanical and electrical properties. The thickness of the strip stock in a preferred embodiment is 0.020 inch.

Figure 2:
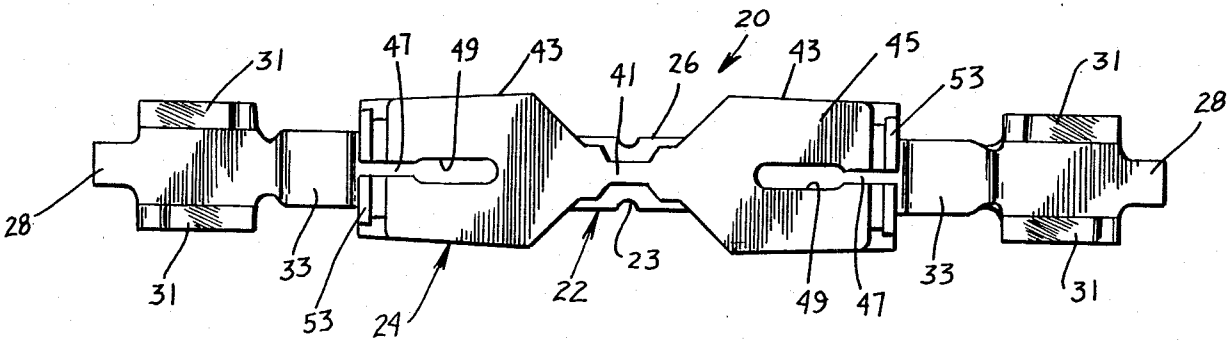
FIG. 2 is a plan view of the connector of FIG. 1.
Figure 3:
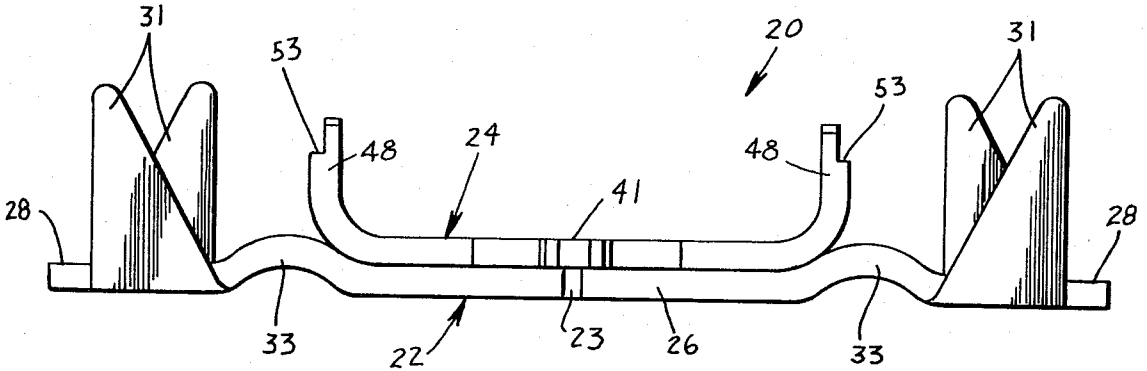
FIG. 3 is a front elevational view of the connector of FIG. 2.

Going now to FIGS. 2–4 together with FIG. 1, it can be seen that the base 22 is made from an elongated strip of material. The strip of material is a Phosphor bronze material which is solder-plated in strip form so that its edges remain unplated. Although the base 22 in the preferred embodiment is made of a metallic material, it could be made of a plastic material.

The base 22 has the same thickness as the contact element 24 but its width differs. Generally, the width of the base is greater than the width of the waist of the contact element. Also, the width is determined so that the break strength of the base 22 across its width is greater than the break strength of any of the conductors to be terminated by the connector. As is seen in FIG. 1, the base 22 may be formed with a significantly narrowed portion 23 which functions as a flex point as the connector and spliced conductors are being advanced over portions of manufacturing apparatus during further in-line processing.

The base 22 includes a center portion 26 and end portions 28—28. Each of the end portions 28—28 is formed with a pair of tangs 31—31 which are upstanding from the plane of the base. The tangs 31—31 are used to secure a conductor to the base 22 and to cooperate with other portions of the connector in providing strain relief for a conductor connected to one end of the connector.

The connector 20 of this invention is designed to terminate a range of conductor sizes. That range is 22 to 26 gauge or insulated conductor diameter sizes of 0.055 to 0.016 inch. The tangs 31—31 at each end of the connector 20 must be short enough to provide adequate clamping for a 26 gauge conductor and long enough to adequately clamp a 22 gauge conductor at the other end of the range.

Interposed between each of the end portions 28-28 and the center portion 26 is an offset portion 33 which is deformed out of the plane of the base 22. Inasmuch as a conductor 21 is positioned longitudinally of the base, it follows the contour of the offset portion 33 before exiting through the end portions 28—28.

In a preferred embodiment of the connector, the overall length of the base 22 is about 0.75 inch and its width about 0.05 inch. An out-to-out distance of the tangs 31—31 is about 0.3 inch which it will be recalled is suitable for securing insulated conductors in the range of 22 to 26 gauge. The offset adjacent to each end of the base 22 projects a distance of about 0.02 inch above the top surface of the base and has a primary curvature of 0.03 inch.

Attached to and supported by the base 22 is the contact element portion 24 (see FIGS. 1-4). For ease of manufacture it may be a contact element such as that shown in priorly mentioned U.S. Pat. No. 3,858,158 which is incorporated by reference hereinto. As can be seen by referring to R. W. Henn et al, the contact element is planar, but it is easily deformed into the configuration of the contact element 24 of the connector 20 of this invention.

The contact element 24 includes a center portion or waist 41 having a width at about 0.017 inch from which two opposed beams 43-43 depend. Each of the beams 43—43 is bifurcated with furcations 45—45 of each defining a conductor-receiving slot 47 having a length of about 0.036 inch. The bifurcated beam 43 at each end of the connector is bent so that a portion 48 of each is upstanding from the plane of the center portion 41.

The bending of the portions 48—48 of the contact element 24 at its ends is accomplished in a manner which does not deform the grain structure of the metal. It has been determined that a bend radius equal to the product of about one and one-half the thickness of the base 22 is suitable.

Each conductor-receiving slot 47 communicates with an elongated slot 49 adjacent to the center 41 and with a conductor-entry portion 51. The conductor-entry portion 51 may be formed to include a ledge 53, either in the inside or the outside of the center of the connector. The ledge 53 is helpful in causing insulation displacement to allow an electrical connection to be established with a conductor as it is moved into a conductor-receiving slot.

As can be seen in FIG. 1, upper outside portions of each furcation 45 are beveled between the ledge 53 and the free end of the beam. This is done in order to minimize damage to surrounding conductors when connectors 20—20 of this invention are used to make a plurality of splices in one location such as, for example, splicing jumper wires on a main distributing frame.

The contact element 24 with its end portion upturned has an overall length of about 0.36 inch. Each end is upturned with a radius of about 0.03 inch with an upper end of the contact element being about 0.098 inch above the base 22. The maximum width of the contact element 24 is about 0.104 inch.

In a preferred embodiment, the contact element 24 is welded to the base. This is accomplished with a two projection weld and with each projection being disposed between the contact element waist 41 and upstanding end portion. Although welding has been used in the preferred embodiment to attach the contact element to the base, other attachment arrangements such as an adhesive, for example, could be used.

The contact element 24 is attached to the base 22 with two projection welds each spaced about 0.05 inch from a transverse centerline of the contact element. Each of the welds is made along the longitudinal centerline of the connector 20. This is sufficient to secure the contact element 24 to the base 22 but allows freedom of movement of the furcations 45—45 of the beams 43—43 as conductors 21—21 are moved into the slots. This arrangement accommodates torsional stresses which may be caused by the movement of conductors 21—21 into the conductor-receiving slots 47—47.

Figure 7:
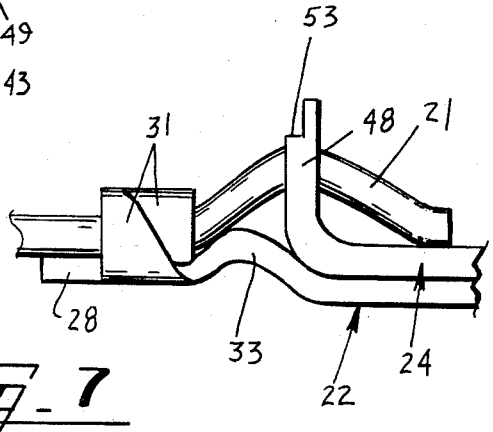
FIG. 7 is a detail view of a portion of the connector of FIG. 1 to show the mechanical and electrical connection of a conductor to the connector.

In order to use the electrical connector, a factory person or an installer using tooling (not shown) causes an end portion of one conductor 21 to be positioned through the tangs 31—31 and into the conductor-receiving slot 47 at one end of the contact element 24. The free end of the one conductor 21 extends to the middle of the contact element 24 and outwardly therefrom (see FIG. 5). Then a second conductor 21 which is to be spliced to the first is positioned in the opposite portion of the connector 20 with its free end extending outwardly from the waist 41. The tooling is caused to be operated to sever the free ends of the conductors 21—21 (see FIG. 6) to cause each conductor to be moved into its conductor-receiving slot and to cause the tangs 31—31 at each end to be wrapped about the adjacent conductor to secure it to the connector. As a result of these steps, each conductor 21 is positioned about 0.008 inch below the ledge 53 of the beam 43 (see FIG. 7).

Figure 8:
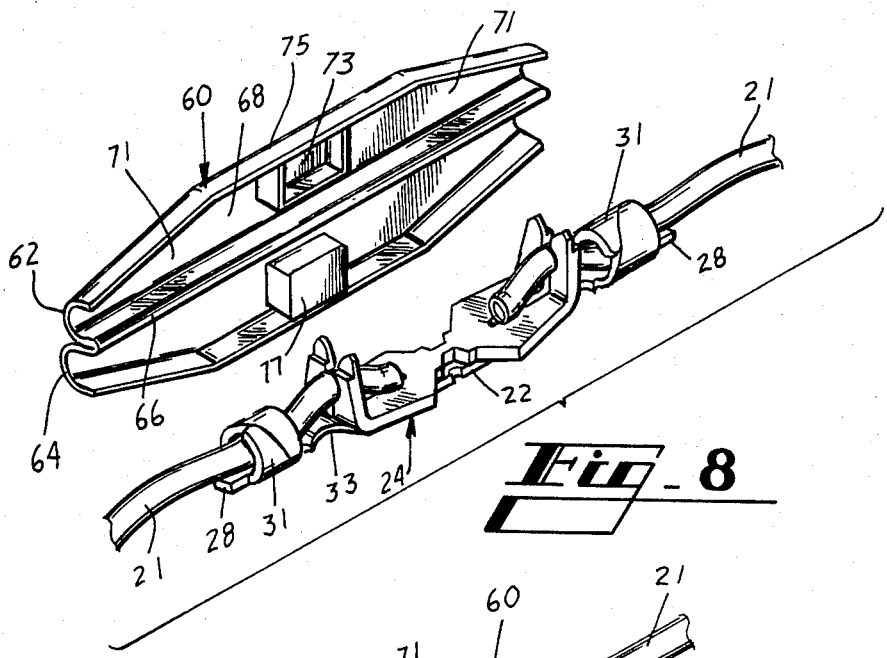
FIGS. 8–10 are perspective views of the connector of FIG. 1 together with a plastic cover which is used to enclose the connector.
Figure 9:
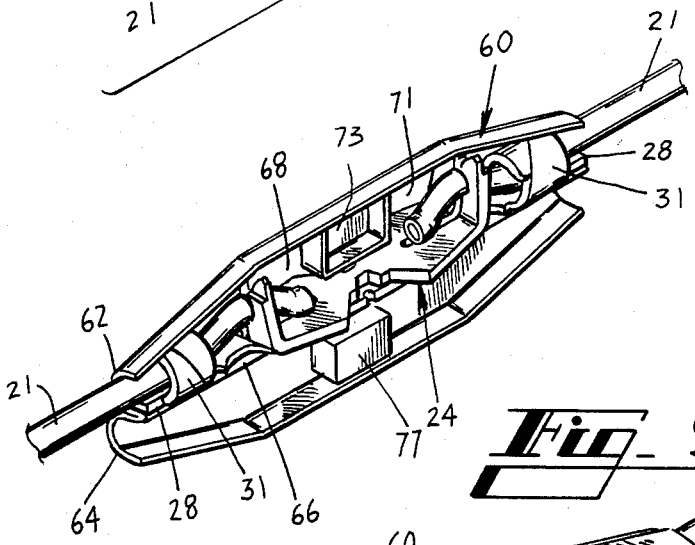
Figure 10:
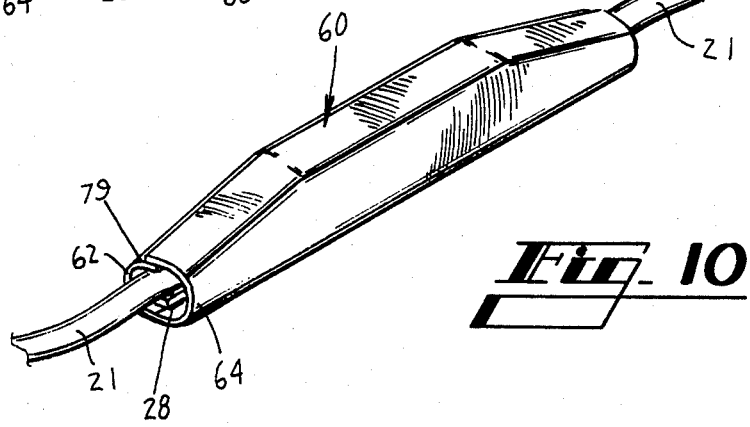

After the connections have been made, the connector 20 is enclosed with a cover 60 (see FIGS. 8-10). The cover 60 includes two portions 62 and 64 which are connected through an integrally formed hinge 66. Each portion 62 and 64 has a generally U-shaped cross-section and includes a constant width center section 68 and a tapered section 71 at each end. The portion 62 includes a well 73 adjacent to an outside wall 75 and the other portion, portion 64 includes a tab 77 that is designed to be received in an interference fit in the well.

The cover 60 in an open position is disposed about the connector 20 having conductors 21—21 secured thereto. The cover 60 is closed to cause the tab 77 to be received in the interference fit in the well 73 of the portion 62. An overlapped seam 79 is formed between the portions 62 and 64. The U-shaped configuration of each portion 62 and 64 allows it to circumscribe the connector 20 and the conductors 21—21 at the ends thereof.

The use of the cover 60 facilitates the waterproofing of the electrical connection between the conductors 21—21. A waterproofing compound such as that disclosed in U.S. Pat. No. 4,176,240 which issued on Nov. 27, 1979 in the name of R. A. Sabia, is introduced into one or both portions of the cover 60 prior to moving the portions into the closed position.

The electrical connector 20 possesses a number of advantages over prior art connectors. It is inexpensively manufactured is easily used, and occupies a minimum amount of space. The connector 20 having two conductors spliced thereto does not occupy much more space than the conductors themselves. As such, it is ideally suited for manufacturing use during the in-line processing of conductors and cables.

Figure 6:
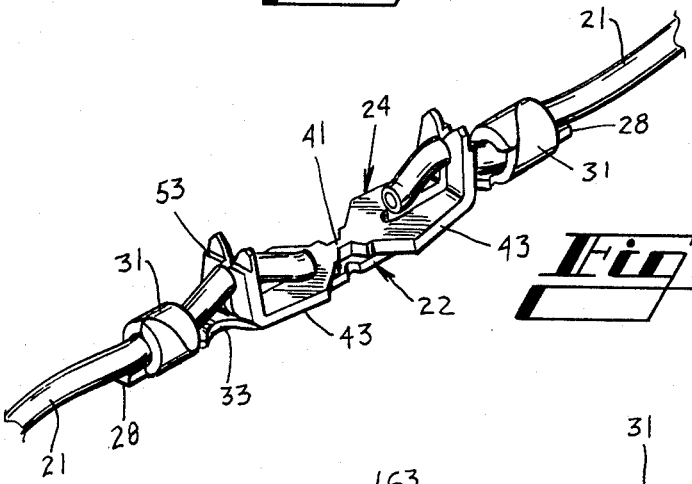
FIG. 6 is a perspective view of the connector after the connection of two conductors and the trimming of the ends.

Advantageously, the conductor need not be sized prior to its connection. Sizing is required in some prior art connectors in which end portions of the conductors are inserted into holes wherein the connections are made. This requires a check of the end portions to ensure that the conductive elements are coextensive with the insulation. With the connector 20, each end portion is directed away from the contact element 24 and connection is made at a point sufficiently spaced from the conductor to insure electrical contact. Excess end portions of the conductors are easily trimmed, as is shown in FIG. 6.

Also of importance is the separateness of the mechanical and electrical connections of an in-line splice to relieve stressing of the electrical connection. The electrical connection is provided by the contact element 24 and the mechanical connection is provided by the support portion 22. The contact element 24 is effectively isolated from forces which are applied to the mechanical connection portion of the connector. As a result, there is no impairment of the electrical connection to the contact element 24 and a gas-tight connection is maintained throughout the life of the connections.

The configuration of the offset 33 at each end of the base 22 between the contact element 24 and the tangs 31—31 is important to the mechanical connection of the conductor to the connector. In some prior art connectors, the conductors are secured within connectors by bending over tangs or tabs along a straight line path of the conductor. Forces which may be imparted to the conductors that are connected by the connector 20 are resisted by the crimped connection comprising the offset 33 at each end cooperating with the deformed tangs 31—31. Without the offset 33, pulling forces which are imparted to a conductor 21 could be applied directly through the portion of the conductor secured by the tangs 31—31 to that portion received in the slot 47 of the contact element. This of course could disturb the otherwise gas-tight electrical connection. With the connector 20, the conductor 21 at each end follows a somewhat tortuous path. The offset 33 at each end of the base interrupts the linear path between the tangs 31—31 and the upstanding portions 48—48 of the adjacent beam 43 of the contact element. As a result, the offset 33 at each end of the connector 20 cooperates with the adjacent tangs 31—31 to interrupt axial pulls in the conductor and diminish any forces which are applied to the adjacent beam 43 of the contact element portion so that they are tolerable and do not effect the electrical connection. This arrangement substantially prevents inadvertent longitudinal movement of the portions of the conductors 21—21 that are disposed in the conductor-receiving slots 47—47 of the contact element beams 43—43.

Not only does the connector 20 include facilities for making a mechanical connection and a separate electrical connection, but the mechanical connection is such that the probability of pull-out is greatly reduced. The base 22 and the contact element 24 are configured to provide a pull-out resistance for each insulated conductor which is at least 85% of the breaking strength of the metallic portion of the insulated conductor 21. The base 22 is configured so that the offset portion 33 is adjacent to one of the upstanding portions 48—48 of the contact element 24 when the contact element is attached to the base. This arrangement is effective to provide the relatively high pull-out strength and to maintain the conductor secured to the connector. In one example, for a 26 gauge copper conductor, the break strength of the wire portion is about 7 pounds while the pull-out strength for the conductor terminated with the conductor 20 is about 6 pounds.

The electrical connector 20 does not require the connection of both conductors 21—21 at the same time. Should there be limitations as to time and/or space, one conductor 21 may be secured to the connector 20 and then at a more convenient time and/or location, the second conductor 21 connected thereto. The cover 60 is assembled to the connector 20 after the last connection is made.

Figure 11:
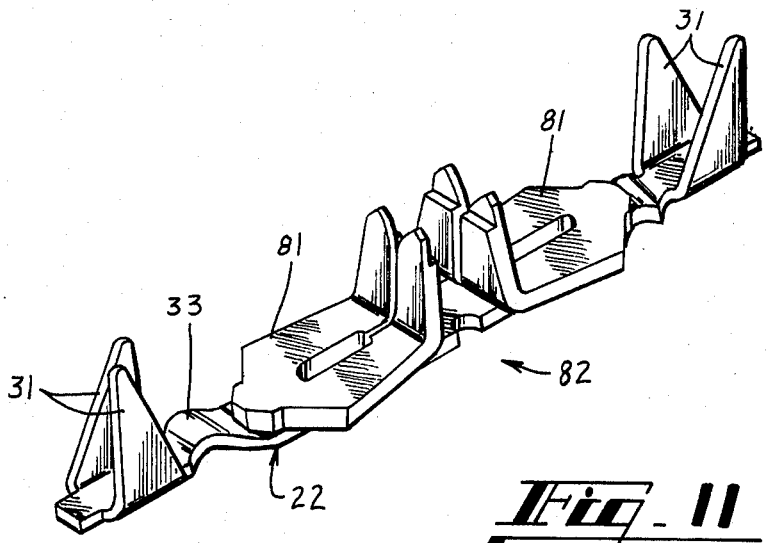
FIG. 11 is a perspective view of an alternative embodiment of the electrical connector.

It should be apparent that the contact element portion 24 of the connector 20 could be modified from the configuration shown in FIG. 1. For example, the contact element 24 could be severed across its waist 41 to form two halves 81—81. Then each half 81 of the contact element is attached to the base 22 with the waist portion of each being disposed adjacent to the offset 33 to form a connector 82 which is shown in FIG. 11.

Figure 13:
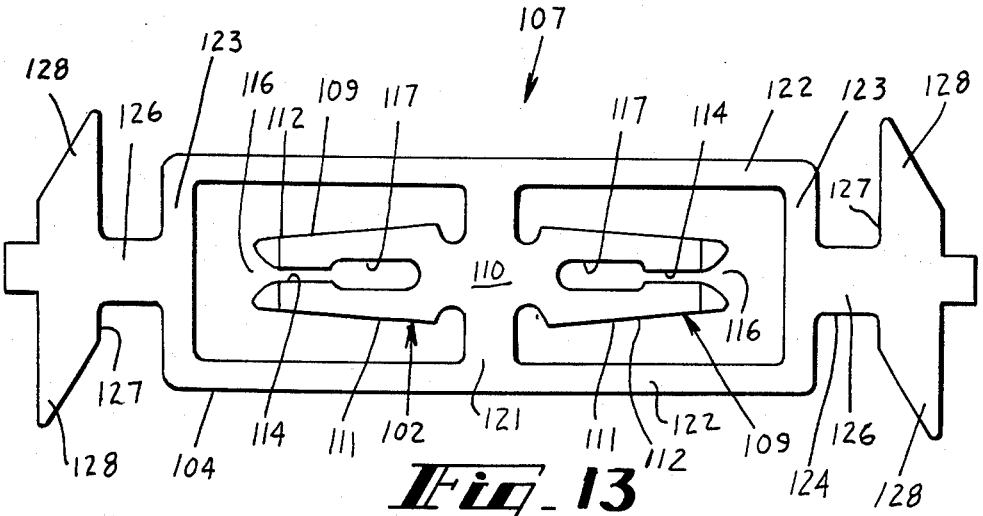
FIG. 13 is a plan view of a portion of a portion of a strip after it has been advanced through a progressive punch and die apparatus to provide a blank for the connector of FIG. 12.

In another embodiment, a connector 100 (see FIGS. 12–13) which is made from a single piece of metal is formed into a contact element portion 102 and a support such as a frame 104. Accordingly, a strip (see FIG. 13) of metallic material is advanced through a progressive punch and die apparatus (not shown) to form a plurality of blanks 107—107.

Each blank 107 includes a partially formed contact element portion designated generally by the numeral 109 which includes a center portion 110 and two opposed beams 111—111. Each of the beams 111—111 includes a bifurcated end portion 112 between the furcations of which is formed a conductor-receiving slot 114. An entrance 116 communicates with one end of the slot 114 and an enlarged slot 117 communicates with the other end and extends toward the center portion.

Connected to the center portion 110 of the contact element portion 109 is the support frame 104. The support frame 104 includes center portions 121—121 that are connected to the center portion 110 of the contact element portion 109 and to a frame 104. The frame 104 includes side portions 122—122 that extend parallel to the contact element portion 109 and end portions 123—123. Each end portion 123 is joined to a conductor securing portion 124 having a neck 126 and a portion 127 at an end thereof. The portion 127 is oblong to facilitate its formation into conductor-securing tangs 128—128.

Figure 12:
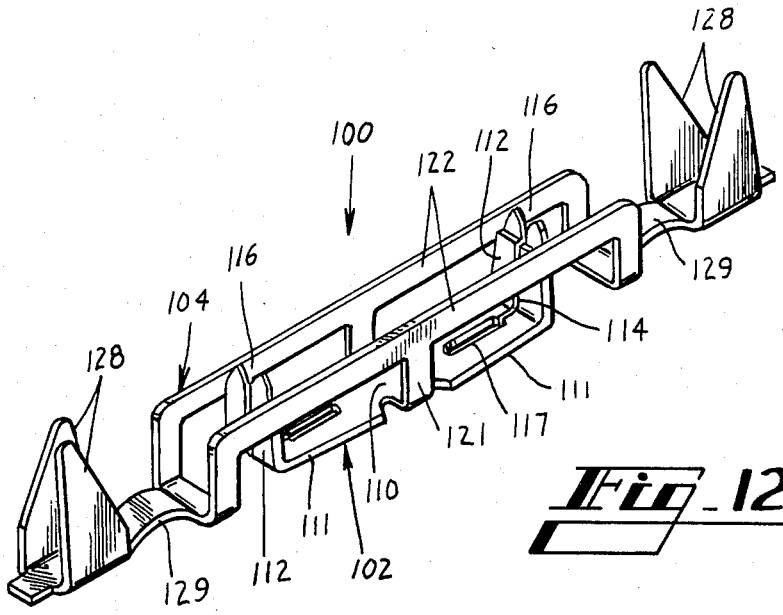
FIG. 12 is a perspective view of another embodiment of the electrical connector which is made from one piece of metallic material.

Each blank 107 is separated from its carrier strip and formed into the connector 100. End portions of each beam 109 are bent so that they are disposed at an angle of 90° to the waist portion 110 (see FIG. 12). Then the sides 122—122 of the frame 104 are turned upwardly from the plane of the strip to form the U-shaped configuration at each end of the frame as shown in FIG. 12. The end portions 123—123 of the frame 104 depend downwardly from the side portions 122—122 with the conductor-securing portions 124—124 extending therefrom. Ends of the portions 127—127 are turned upwardly to form the tangs 128—128 for securing conductors to the connector. A portion of the frame 104 adjacent to each depending portion of the frame 104 is formed into an offset 129.

As in the use of the connector 20, a conductor 21 is positioned through the tangs 128—128 in engagement with the offset 129 and through an entrance 116 to one of the conductor-receiving slots 114—114. Tooling is operated to cause the tangs 128—128 to be folded over to secure the conductors and to move the conductor into the slot 114. A second conductor 21 is caused to be secured either simultaneously or subsequently to the other half of the connector. The ends of the conductors 21—21 which are secured to the connector 100 are severed as before.

Figure 15:
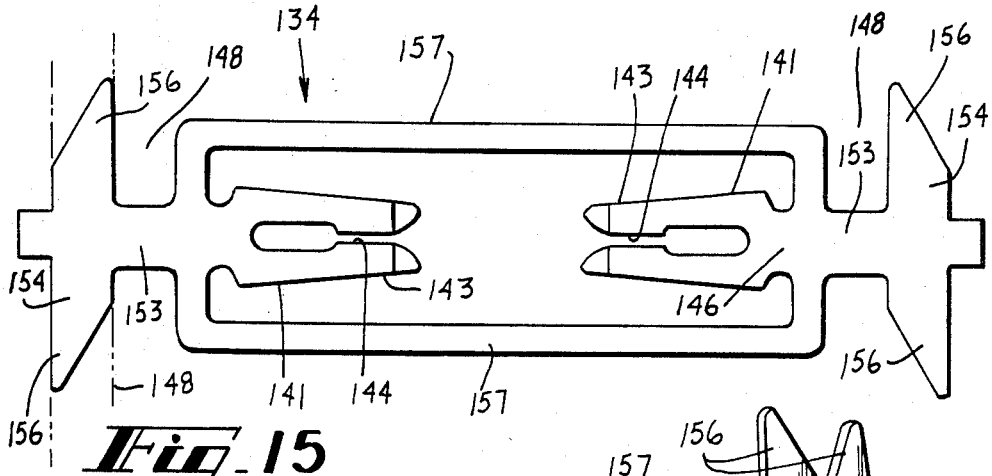
FIG. 15 is a plan view of a blank from which the connector of FIG. 14 is formed.
Figure 14:
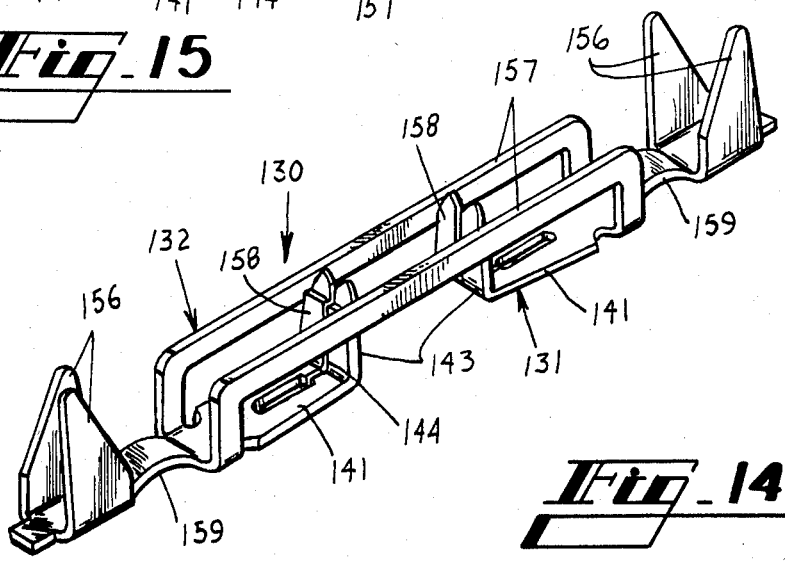
FIG. 14 is a perspective view of still another embodiment of the electrical connector.

Still another embodiment of a connector is shown in FIGS. 14–15. A connector designated generally by the numeral 130 includes a contact element portion 131 and a frame portion 132. As in the embodiment designated 100, the connector 130 is made from a blank 134 (see FIG. 15) that has been formed in a strip which has been advanced through a plurality of workstations.

The contact element portion 131 includes two opposed beams 141–141 having bifurcated end portions 143—143. The furcations of each bifurcated end portion have a conductor receiving slot 144 formed therebetween. The frame 132 provides the electrical connection between the bifurcated end portions. The other end of each beam 141 is connected through a neck 146 respectively to an end portion of the frame 132 at which is located a conductor-securing portion 148. Each conductor-securing portion 148 includes a neck 153 and an oblong portion 154 which is destined to be formed into tangs 156—156 (see FIG. 15).

The blank 134 is separated from the carrier strip and formed into the configuration shown in FIG. 14. Sides 157—157 of the frame 132 are turned upwardly into a U-shaped configuration and end portions 158—158 of each beam 141—141 are caused to be upstanding. An offset 159 is formed in each neck 153 and the oblong portions 154—154 turned to provide the tangs 156—156 in the orientation shown in FIG. 14.

Figure 16:
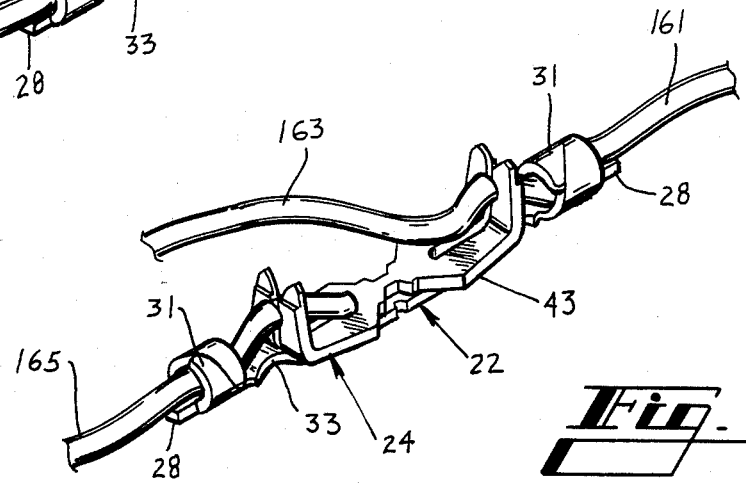
FIG. 16 is a perspective view of the connector as it is used in a half-tap operation.

The connector 20 also may be used to provide a half-tap connection. Such a connection is used when it is desired to connect existing communication lines to replacing equipment without experiencing any discontinuity in service. The use of the connector 20 to effect such a connection is shown in FIG. 16.

A craftsperson positions each of a plurality of conductors 161—161 which extend from subscriber equipment, for example, and which includes portions 163—163 that extend to existing equipment through one slot 47 of the contact element 24 of a connector 20. Then each of a plurality of conductors 165—165 which extends to the replacing equipment (not shown) is caused to be moved into the other slot 47 of the contact element 24. It is well to note that after this has been done for each conductor that is connected to the present equipment, service to it is still provided to the subscribers. Subsequently, the craftsperson severs each of the portions 163—163 of conductors that extend to the present equipment between that equipment and the slots 47—47 of the contact element beams 43—43 through which they extend. This leaves each connector 20 terminating the conductors 161—161 to the subscribers and the conductors 165—165 to the replacing equipment to establish electrical connections therebetween without any interruptions in service.

It is to be understood that the above-described arrangements are simply illustrative of the invention. Other arrangements may be devised by those skilled in the art which will embody the principles of the invention and fall within the spirit and scope thereof.

What is claimed is:

1. A method of making an electrical connector, said method including the steps of:

moving a strip of metallic material through a plurality of workstations;

removing material from the strip to form a blank including contact element means which includes two opposed beams connected together electrically and having bifurcated first end portions with the furcations of each bifurcated end portion having a conductor-receiving slot formed therebetween, the blank also having a frame which includes lateral portions extending transversely across the strip for supporting said contact element means and being connected to second end portions of the beams and which is connected at each end to an end portion of the connector along which are formed tangs for securing a conductor to the connector;

separating each blank from the strip;

causing portions of the first end portions of the beams to project from the plane of the blank;

bending the tangs at each end of the connector out of the plane of the blank to cause them to be adapted to receive a conductor and adapted to be wrapped about the conductor; and forming an offset in each end portion of the connector between the tangs at that end and the frame.

2. The method of claim 1, wherein the lateral portions of the frame are turned out of a plane of the blank to extend parallel to a plane which includes the second end portions of the beams and the end portions of the connector along which the tangs are formed.

3. The method of claim 1, wherein the first end portions of the beams are adjacent to each other and the second end portions are connected to opposed ends of the frame at junction points with the end portions of the connector.

4. The method of claim 1, wherein the first end portions of the beams are spaced apart through a waist portion and the second end portions of the beams are connected through the waist portion which is connected to a lateral portion of the frame.

* * * * *